US005303430A

United States Patent [19]

Fernie et al.

[11] Patent Number: 5,303,430

[45] Date of Patent: Apr. 19, 1994

[54] CONVERSION KIT FOR ADJUSTING THE HEIGHT OF A FLUSH TOILET

[76] Inventors: Geoffrey R. Fernie, 29 Blaketon Road, Islington, Ontario, Canada, M9B 4W4; Brian P. Doyle, 36 High Park Blvd., Toronto, Ontario, Canada, M6R 1M8; David Khazanovich, 4866 Bathurst St. #508, North York, Ontario, Canada, M2R 1X4

[21] Appl. No.: 991,532

[22] Filed: Dec. 14, 1992

[51] Int. Cl.[5] ..... E03D 11/00

[52] U.S. Cl. ..... 4/254; 285/59

[58] Field of Search ..... 4/254, 252.1, 252.4, 4/252.5, 252.6; 285/56-60

[56] References Cited

U.S. PATENT DOCUMENTS

| | | | |
|---|---|---|---|
| 2,673,985 | 4/1954 | Gay | 4/252.1 X |
| 3,896,510 | 7/1975 | O'Connell | 4/252.1 |
| 4,144,597 | 3/1979 | Guenther et al. | 4/254 |
| 4,515,398 | 5/1985 | Machon | 4/252.5 X |
| 4,554,689 | 11/1985 | Segler | 4/254 |
| 4,794,653 | 1/1989 | Strasser | 4/252.1 |
| 5,018,224 | 5/1991 | Hodges | 285/59 X |

*Primary Examiner*—Charles E. Phillips

[57] ABSTRACT

A spacer for a flush toilet is an insert block locatable between the base of a toilet pedestal and the floor. The spacer has a passage therethrough from top to bottom constituting a soil pipe extension and located to mate with the soil pipe and the toilet outlet. Preferably the spacer comprises a series of sub-spacers to allow for raising the toilet as much or as little as necessary. Sealing lugs are provided for sealing against soil leakage. Arm rests may be provided supported at least partially on cross members located in trough passages of the sub-spacers and the arm rests may be hingable out of their "in use" position to allow easy access of a wheelchair.

13 Claims, 6 Drawing Sheets

CONVERSION KIT FOR ADJUSTING THE HEIGHT OF A FLUSH TOILET

FIELD OF THE INVENTION

This invention relates to the conversion kit for altering the heights of the flush toilet.

DESCRIPTION OF THE PRIOR ART

Raised toilets above the standard level of around 14 inches are desirable for various purposes especially for use by invalids and persons confined, or partially confined, to a wheel chair. For such persons the most suitable height of a toilet may be such that the toilet seat is level with the seat of the wheel chair. For other purposes the toilet height may be less than the height of the wheel chair seat but higher then the height of the conventional toilet seat. For example, for some disabled persons e.g. those with arthritis who are at least partially ambulatory, a slightly raised toilet may be desirable so that they may descend to and rise from sitting position more easily.

In hospitals, nursing homes and other public facilities, specially designed higher than standard level toilets may be used for the elderly, infirm and disabled. Such toilets for example of, say, 18 inches in height are often provided with side rails or arm rests which, while being movable into or out of position, maybe either an integral part of the toilet or a fixed fitting around it. Such toilets and their associated guard rails or arm rests may be very expensive and unattractive. They are generally unsuitable for installation in a private house in which it may be especially desirable to provide a generally aesthetic appearance. In this respect, colour coordination of the "institution type" raised toilets is impossible or virtually impossible for a domestic market. These especially designed toilets are normally only available in white.

Usually the toilets designed for the use of wheel chair patients have a seat level of about 18 inches or generally similar to that of a wheel chair. Thus a wheel chair patient may draw the wheel chair alongside and lever himself from the chair seat to the toilet seat. However, such toilets of wheelchair seat level may not be suitable for ambulatory disabled who do not require such a high seat. (In this specification a person or patient will be referred to in the masculine for simplicity. It will, of course, be appreciated that this person could equally be female. All statements are intended to apply to persons of either sex).

While such customized toilets are suitable in the hospital environment, they are expensive even in that environment and even in that environment, may not be wholly satisfactory. For example, it may be necessary to replace the toilet by a lower unit, for example for use with a commode wheelchair which may be wheeled into position immediately over the toilet. At present it is necessary to provide a whole new unit.

In the domestic environment the institution type raised toilets are unsightly, expensive and tend to be permanent fittings which are expensive to remove once the disabled persons need for them is over. Indeed, a house which has been extensively and expensively converted for use be a disabled person may be virtually unsaleable in that condition. It may be necessary to reconvert the house at yet further expense and to make good any decorations.

One previously known attempt to solve the problem has involved the use of an insert which is fitted above the toilet bowl and is clamped to it. The seat is either part of the insert or is located above it. These inserts may be unstable in that it is difficult to fix them securely. Moreover, difficulty may be experienced in cleaning the toilet due to the distance of the bowl below the seat.

Arm rests have always presented a problem of fitting securely while allowing easy access of a wheelchair due to the difficulty in fitting them securely in positions where they are useful and in providing suitable means for moving them out of the way when required.

The present inventors have addressed the problems of providing toilet facilities in a domestic environment or in a hospital or other public facilities at a reasonable cost and which utilizes a standard toilet fitting. Thus, the present inventors have addressed the problem of converting a standard toilet to different levels and to reconverting it to standard level if desired.

SUMMARY OF THE PRESENT INVENTION

According to the invention there is provided a conversion kit for raising the height of a flush toilet comprising; a spacer having an upper surface for attaching to a bottom surface of a flush toilet and conforming in shape and size thereto, and a lower surface for fixing to a floor; a soil pipe extension extending through the spacer from a first port in said upper surface to a second port in said lower surface, the first port being located for coincidence with a discharge port of the flush toilet and the second port being located for coincidence with a floor port of a soil pipe, bolt sockets provided through the spacer from top to bottom to be coincident with bolt sockets of the flush toilet; fixing bolts to bolt the flush toilet to the floor each bolt having a shank of sufficient length to pass through the bolt holes of the flush toilet and the bolt holes of the spacer for attachment to the floor; and sealing O-rings to seal the first port of the soil pipe extension with the discharge port and to seal the second port of the soil pipe extension with the floor port of the soil pipe.

Such a spacer conveniently comprises a plurality of sub-spacers, each of which includes bolt sockets for passage of the bolts, for fixing the toilet to the floor and sealing O-rings being provided for sealing between adjacent sub-spacers. By the use of one or more sub-spacers the height of the toilet may be adjusted either to the full height of the wheel chair seat or to lower heights. Indeed, there is no particular reason why a toilet should not be located higher then the height of a wheel chair seat if desired. The height of the sub-spacers may be, for example, about three inches. Such height is merely chosen for convenience and other heights may be equally suitable.

The spacer or sub-spacers may conveniently be manufactured from rigid thermoplastic material. They may perhaps be of hollow frame construction with sufficient framework for rigidity. Alternatively, the spacers or sub-spacers might be moulded with an outer skin of rigid thermoplastic material and an inner strengthening filling of foamed or other material. They may be of solid structure of a plastics material of suitably low shrinkage characteristics. A further alternative material might be ceramic or other conventional materials from which toilets are made. No limitation on material is intended.

The base of the spacer or the lowermost sub-spacer may be provided with a stabilizing flange which extends outwardly beyond the extent of the base of the toilet.

The flange lower surface extends from and is flush with the lower surface of the spacer. Thus, the lowermost spacer has an extended lower surface for fitting against the floor.

Also for stability in a lateral direction, groove and tongue fittings may be provided between adjacent spaces. Such fittings may impede any tendency of the spacers to slide one upon the other or to rock when subjected to lateral stresses.

The spacer may be provided with at least one mount for at least one side rail support. The mount may suitably comprise a socket extending laterally into the spacer to house a cross member of the side rail support. Indeed, the socket may extend right through the spacer from side to side. Preferably such sockets are provided both forwardly of the soil pipe extension and rearwardly of it. Such a socket is open at each end, each open end to house a cross member of a side rail support.

When the spacer is comprised of several sub-spacers, the socket may be formed by a groove extending from side to side of each sub-spacer downwardly from the upper surface. In this case it is possible to use a single cross member to provide for side rails on both sides of the toilet. When assembling the sub-spacers, the cross member is located in the groove and a further sub-spacer will be located on top of it. The side rails may then be fitted to the projecting ends of the cross member. Preferably, each side rail support is fitted to two cross members in mounts respectively forward of the soil pipe extension and rearward of the soil pipe extension. When two side rails are present, each of the mounting sockets may extend through the spacer or sub-spacer. When sub-spacers are used in which the mounts are grooves, a single cross member may be used forwardly of the soil pipe extension and a single cross member may be used rearwardly of the soil pipe extension. The provision of mounts for cross members of side rail supports of this type may make it relatively convenient to disassemble the side rails if they are not required thus possible enhancing the general appearance of the toilet.

In any event, when side rails are used it is convenient that they should be movable into and out of position for easy access of a wheel chair. When the sub-spacers have two grooves extending laterally thereto to mount a cross member, the cross member may be U shaped. The web of the U extends in the groove of the respective sub-spacers to extend therefrom. The legs of the U are formed by upstanding female members. Indeed, the entire cross member may be tubular. Thus, two female members will upstand to each side of the toilet. The side rail itself may be provided with two downwardly extending male members located to fit in the female members. For hinging of the side rail, one of the male members will be longer than the other. The side rail may therefore be lifted to disengage the shorter male member and it may then be pivoted on the other male member to swing the side rail out of the way. Conveniently the shorter male member is forward of the longer male member. Thus, the side rail will pivot from a rearward point.

It may be convenient to provide a hinged safety bar extending between the side rails when they are located to each side of the toilet. The hinged safety bar may pivoted on a front portion of one of the side rails so that it may be set across the side rails in front of a person seated on the toilet. It may then be utilized to prevent the person falling forwards off the toilet or the person may push down on the safety bar for leverage in final adjustment of position or as an aid to evacuation.

The safety bar may be pivoted out of position and when not used may lie parallel to the side rail to which it is pivoted.

BRIEF DESCRIPTION OF THE DRAWINGS

An embodiment of the invention will now be described by way of example with reference to the accompanying drawings in which.

DETAILED DESCRIPTION OF A PREFERRED EMBODIMENT

Figure 1:
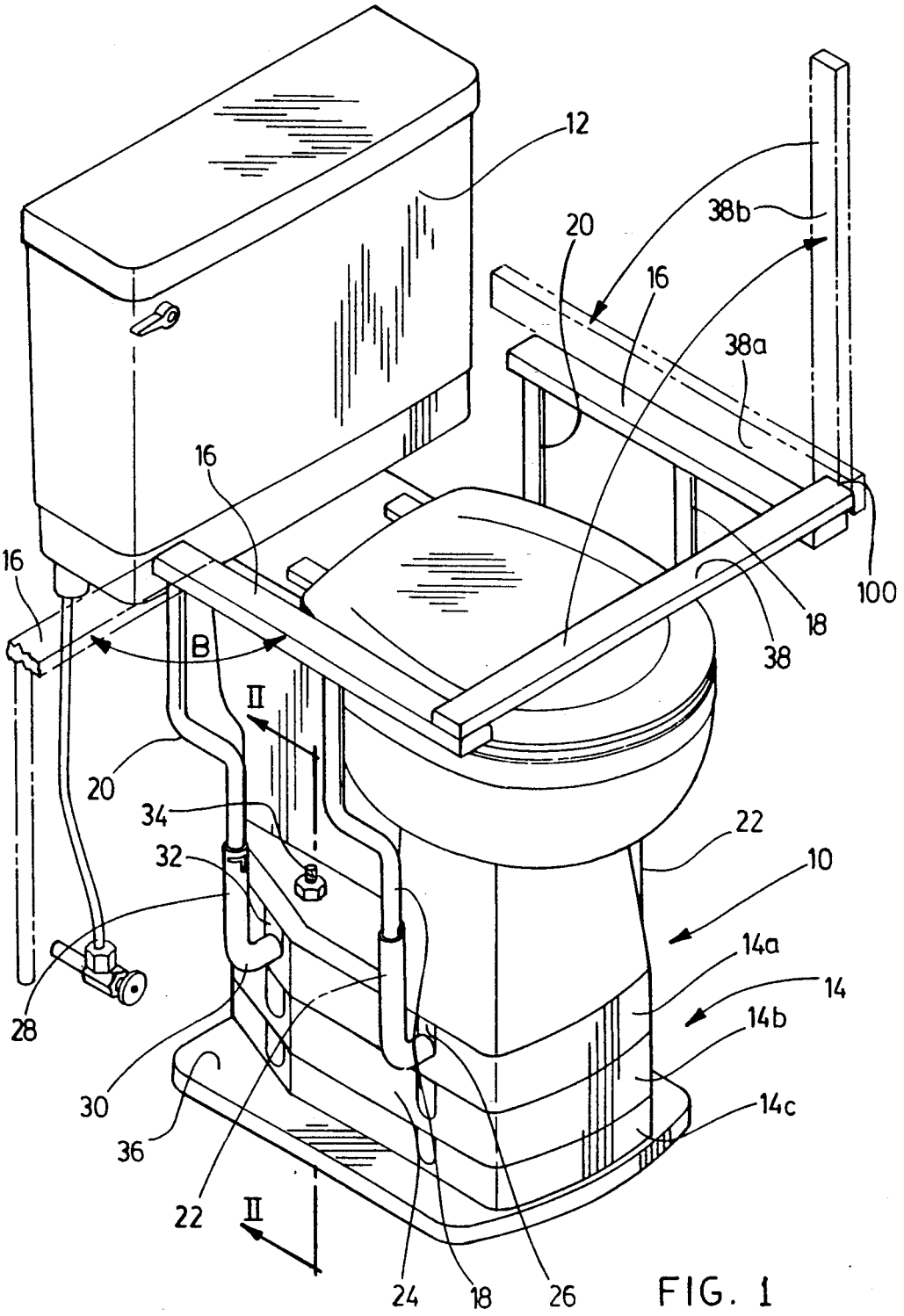
FIG. 1 is a perspective view of a toilet raised by a kit according to the invention and including side rails.
Figure 2:
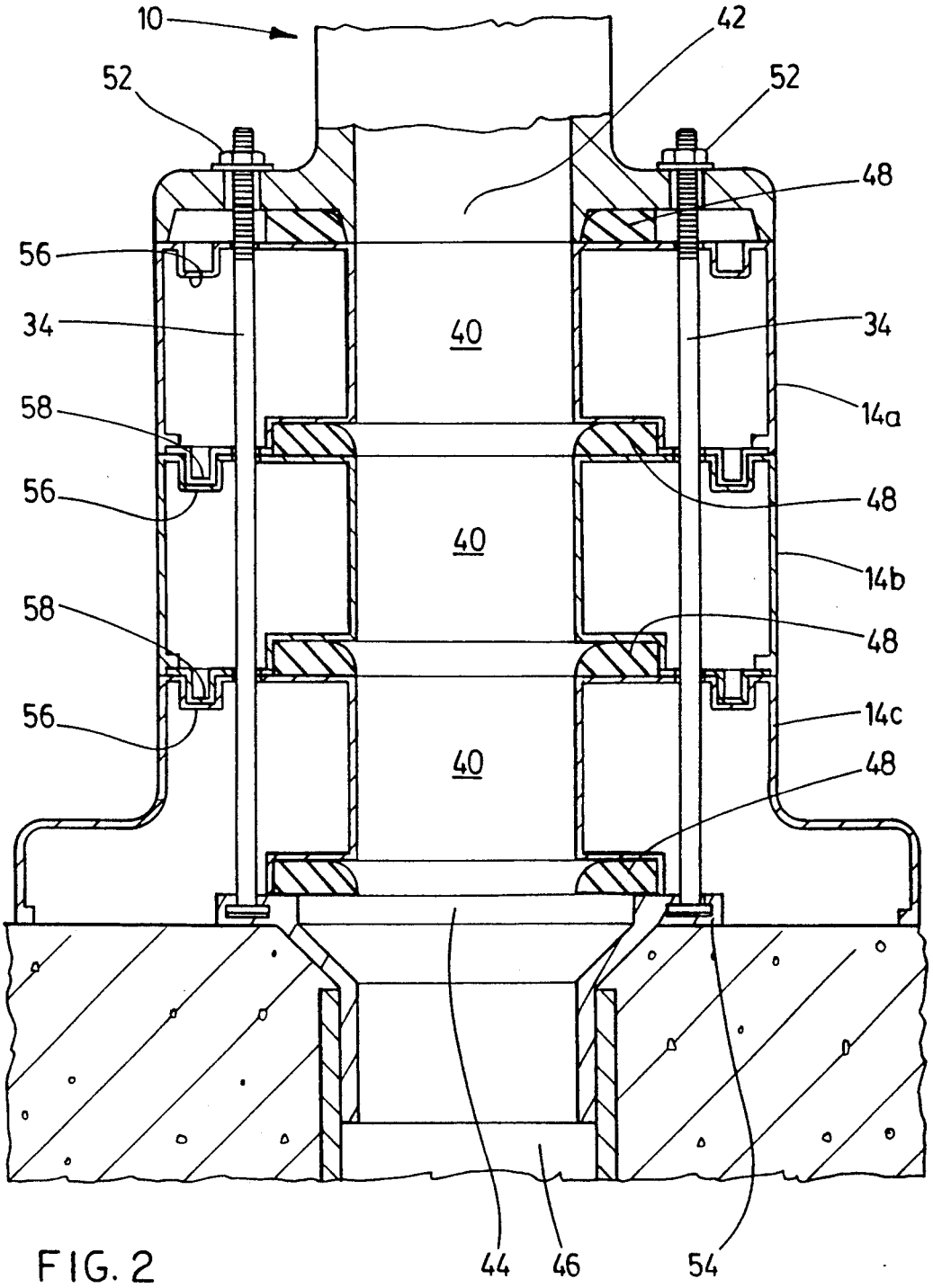
FIG. 2 is a vertical section on the line II—II of FIG. 1.

In the drawings, a toilet 10 and integral tank 12 are raised from a standard height by means of a spacer 14 comprising sub-spacers 14*a*, 14*b* and 14*c*.

The toilet 10 is provided with side rails 16 each side rail 16 having a downwardly projecting front support member 18 and a downwardly projecting rear support member 20. The front members 18 are located in upwardly directed, open ended legs 22 of forward cross member 24 which, itself, is located mounting groove 26 of sub-spacer 14*a*. Similarly, rear members 20 are located in upwardly projecting legs 28 of rear cross member 30 located in mounting groove 32 of sub-spacer 14*a*. The members 18, 20 may be cranked to support armrests spaced apart a convenient distance for a user at their top ends, and so that their bottom ends are as close to the toilet pedestal as possible so that cross member 24 need not project unduly.

The toilet 10 and spacer 14 are connected to the floor by bolts 34. Lowermost sub-spacer 14*c* is provided with a bottom flange 36 projecting outwardly flush with the floor for stability.

A safety bar 38 is pivoted on one of the side rails 16 to extend between front portions of both side rails.

Although it is of little importance in the present invention it is worth noting that tank 12 is connected to the water supply through a flexible hose of sufficient length to allow for insertion of the spacer 14 to raise the toilet to the desired level. Tank 12 need not be integral with the toilet 10, in which case, it may remain fixed and the length of the flexible hose will not be at issue in raising the toilet.

The toilet 10 is illustrated as having a base of generally hexagonal shape, the front being curved and the back tapering towards a narrower back wall. Some toilets, of course, have bases of different configuration.

The shapes of the sub-spacer 14*a*, 14*b* and 14*c* as shown, complement the shape of the toilet pedestal base. It will be appreciated that varying commercially available toilets will have differently shaped bases and spacers 14 may be provided to complement the shapes of these toilets also. Alternatively, a "generic" set of spacers may be provided suitable for use with a variety of different pedestals. Such "generic" spacers may have a perimeter sufficiently long and of such a shape as to accommodate the longest pedestal base considered.

Figure 3:
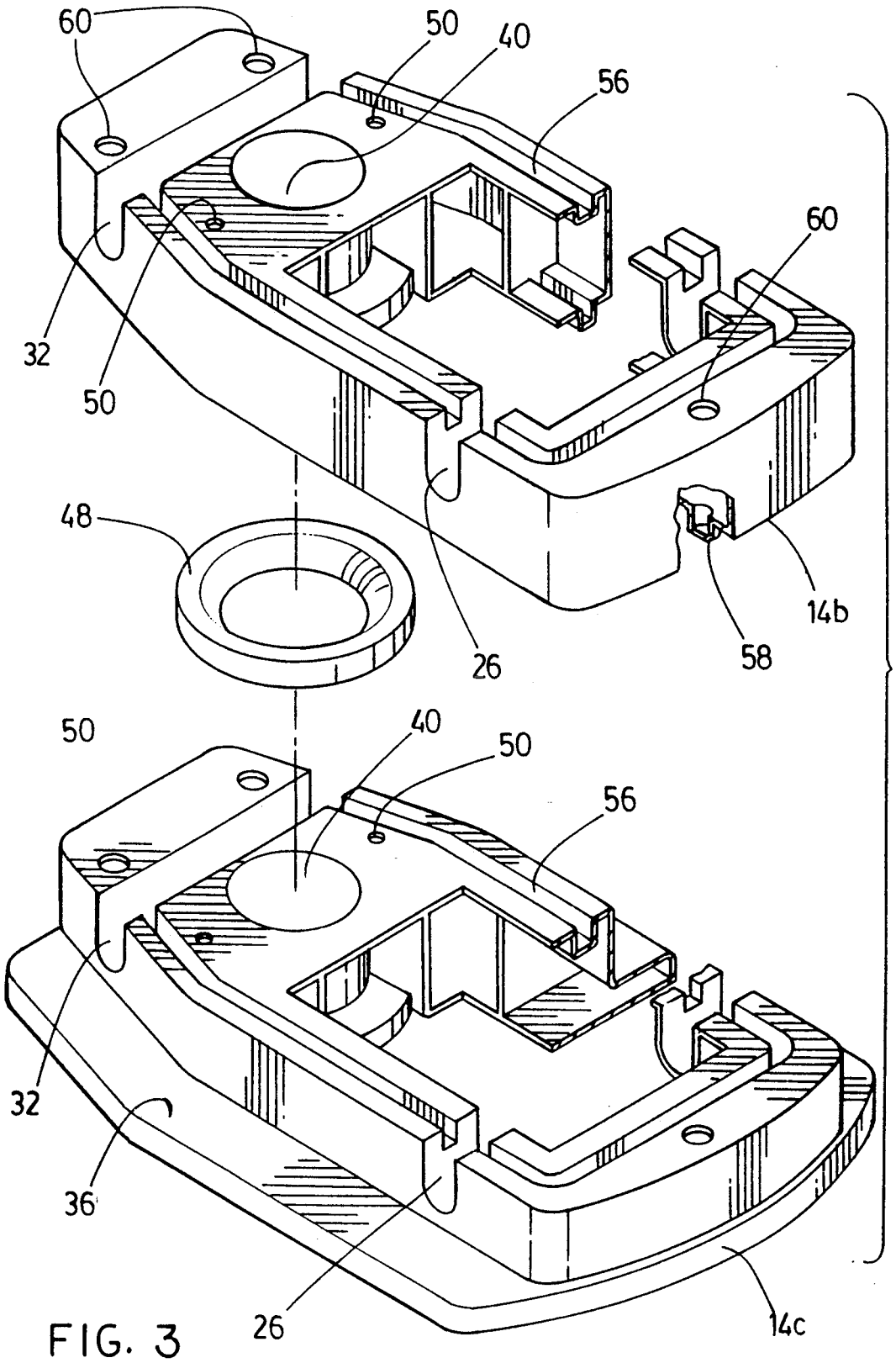
FIG. 3 is an exploded view of two of the phases of FIG. 1.
Figure 8:
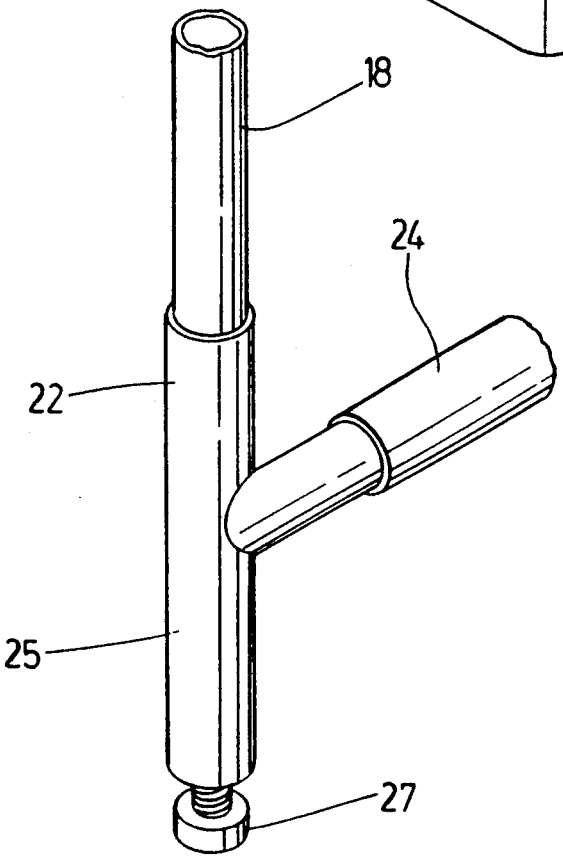
FIG. 8 shows an alternative embodiment of space construction

Each sub-spacer 14*a*. 14*b* or 14*c* may be formed of any suitable material but it is anticipated that they may be moulded in plastic material. It may be preferred that they are moulded in solid form as shown for example in FIG. 8, if difficulties which will be encountered in shrinkage of the plastic can be overcome. FIG. 3 illustrates an exploded view of spacers 14*b* and 14*c* showing the interior broken away to indicate a structural frame work which may suitably be moulded to provide rigidity and strength in the sub-spacers. The illustration of the framework is exemplary only.

Each sub-spacer has a through hole 40 from top to bottom coincident one with each other and with the discharge port 42 of the toilet 10 and with the floor port 44 of the soil pipe 46. The sub-spacers are assembled in fluid tight relationship one with each other and with the soil pipe 46 and with the toilet 10 by means of sealing O-rings 48 and bolts 34 which are located in bolt sockets 50 of the sub-spacers and conventional bolt sockets on the toilet 10. All the bolt sockets are located to be coincident one with in each other. The bolts are tightened by means of nuts 52 to compress sealing O-rings 48 between adjacent sub-spacers or between the top sub-spacer and the toilet and between the bottom sub-spacer and the floor fitting ring 54 of the soil pipe 46.

Preferably means are provided to guard against side ways slippage of sub-spacers 14*a*, 14*b* and 14*c* with respect to one another. Such means may be, for example, a groove and tongue arrangement between the top surface of one sub-spacer and the bottom surface of another sub-spacer. Thus, the sub-spacers may be provided with a groove 56 in their top surfaces, which groove 56 extends generally around the periphery within a margin. This groove 56 co-operates with a tongue 58 on the lower surface of the next sub-spacer above it. Thus groove 56 of sub-spacer 14*c* co-operates with tongue 58 of sub-spacer 14*b*. It is, of course, possible for the tongues to be located on the top surfaces and the grooves on the lower surfaces. Alternatively or additionally, the sub-spacers may be provided with sockets 60 for locating pins. These sockets 60 may be located at any suitable points of the spacers. Generally, however, such sockets 60 for locating pins may be located near the front of the sub-spacers since the bolts 34 will tend to act as locating pins towards the rear.

When it is desired to equip the toilet 10 with side rails 16, mounting means for the side rails may be provided in the spacer 14. When sub-spacers 14*a*, 14*b* and 14*c* are used, the mounting means may comprise a forward groove running from side to side of each sub-spacer and a rearward groove running from side to side of each spacer. A cross member 24 may be located in each of these grooves to project from each end and to carry the side rail supports 18 and 20 of side rail 16. As shown, grooves 26 and 32 extend fully from side to side of each sub-spacer but it is quite possible that a pair of grooves 26 may be stub grooves and need not extend fully through the spacer. Similarly, a pair of grooves 32 may be stub grooves on each side of the respective sub-spacers. The mounting means may be cylindrical bores rather than grooves 26 and 32 especially when spacer 14 is a single integral spacer. Even when the sub-spacers 14*a*, 14*b* and 14*c* are used it is possible to replace grooves 26 and 32 by bores either extending completely through the sub-spacers or as stub sockets.

A cross member may be inserted into the grooves 26, 32 on one side of the toilet only. Alternatively, cross members may be inserted on each side of the toilet. Still further, a single cross member may extend from side to side. As illustrated, the cross members 24, 30 are tubular U-shaped members. The web of each U is assembled into its respective groove during assembly of the sub-spacers so that the legs 22, 28 of each cross member project upwardly. If such U-shaped cross members are to be used with bores rather than with grooves, it will be necessary to either insert an L-shaped cross member on either side and keep them separate, or to provide a screw connection or a bayonet connection between the two L-shaped parts. The upstanding legs 22, 28 are open ended to form female fittings to receive vertical side rail supports 18, 20 respectively. It will, of course, be appreciated that the side rail supports 18 and 20 may be open ended tubes forming female fittings for upstanding legs 22, 28.

Figure 7:
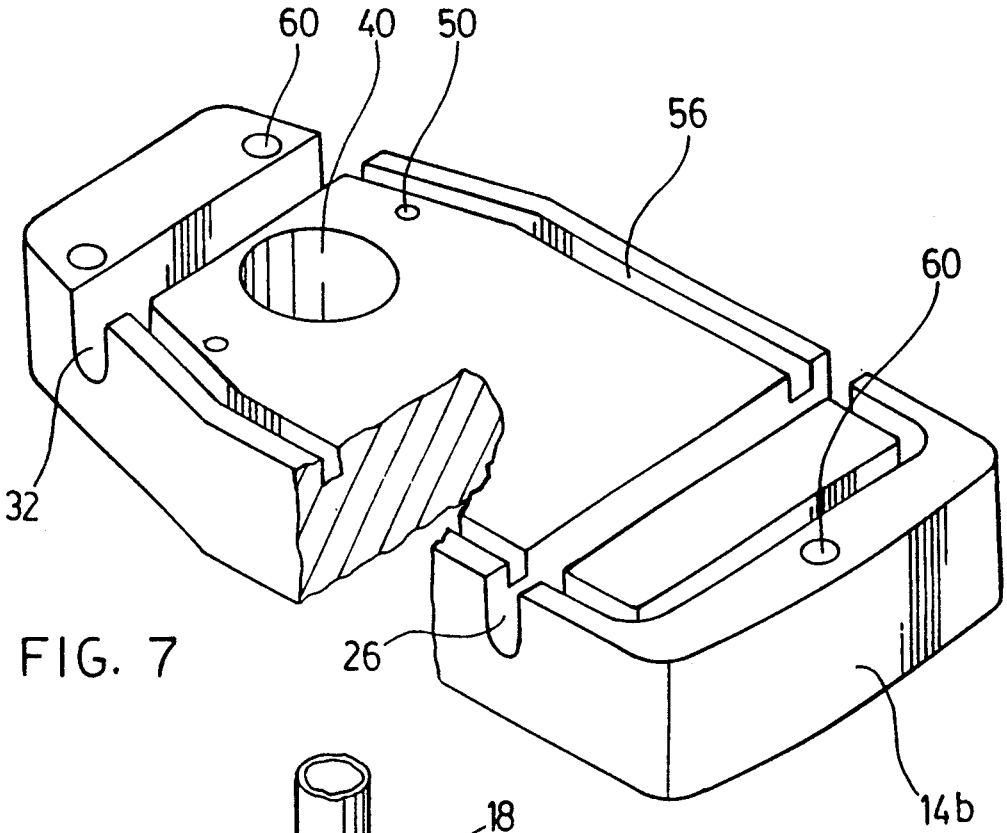
FIG. 7 shows an alternative embodiment of a detail of a leg of one arm rest.

For extra strength legs 18, 20 may be provided with floor supports 25. These may be, for example, as illustrated in FIG. 7 as a further extension of cross member 24 having a height adjustable foot 27. It will, of course, be appreciated that floor supports may be provided in other manners, e.g. by omitting upstanding member 22 from cross member 24 and by providing a simple T fitting for the open end of the cross member. One leg of such T fitting will be floor support 25, one member will be upstanding member 22 and the other member will engage cross member 24.

When either one or two side rails 16 are fitted, it is probable that there will be occasions when it is desired to move one or other of them out of its side rail position as shown in full lines in FIG. 1 into, for example, a position a 90 degrees to it parallel with the rear of the tank or with the rear wall as shown in broken lines in FIG. 1. This may be accomplished by any convenient hinging means. One such hinging means is illustrated in the drawings details of which are enlarged in FIGS. 4 and 5.

Figure 4A:
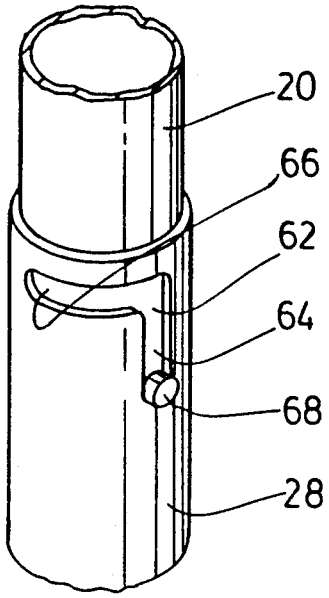
FIG. 4 is a detailed view of a pivot of the side rail, FIG. 4*a* showing the arm locked in position and FIG. 4*b* showing the arm moved out of position.
Figure 4B:
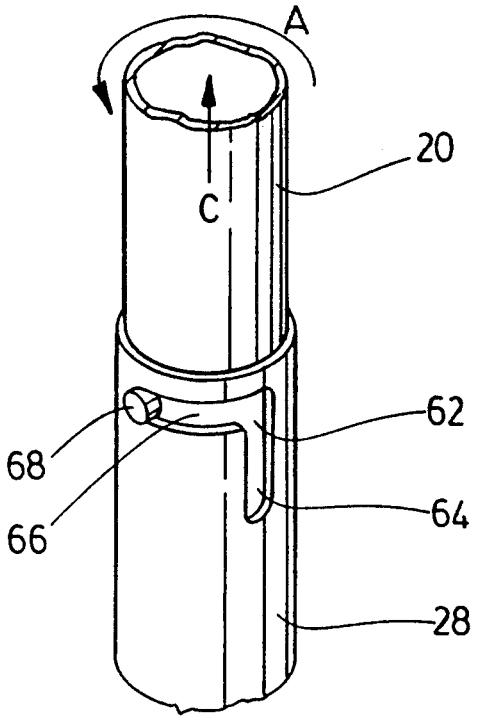
Figure 5A:
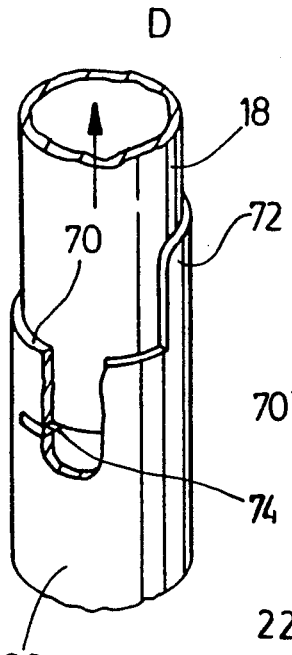
FIG. 5 is a detailed view showing the release of a front side rail support to allow pivoting, FIG. 5*a* showing the member locked in position, FIG. 5*b* showing the member lifted but still in position, and FIG. 5*c* showing the member moved out of position.

FIGS. 4*a* and 4*b* show the pivoting of support member 20 in leg 28 so that the associated side rail 16 can move through 90 degrees from the position shown in full lines in FIG. 1 into the position shown in broken lines. Leg 28 is provided with a suitably located L-shape slot 62 having a vertical arm 64 and a horizontal arm 66. Support member 20 is provided with a projection 68 running in slot 62. The projection 68 may be a retractable button to allow member 20 to be positioned inside leg 28.

When it is desired to pivot side rail 16 out of it effective side rail position, the side rail 16 may be lifted so that projection 68 rises from the blind end of arm 64 of slot 62 to its junction with its slot 66. Support member 18 also rises on lifting of side rail 16 and may be dimensioned to lift out of leg 22 of cross member 24.

Once side rail 16 has been lifted in the direction of arrow C in FIG. 4*b* to position projection 68 at the junction of leg 66 of slot 62. The member 20 may be rotated in the direction of arrow A in FIG. 4*b* to reach the position shown in that figure. During this rotation the member 18 will move in the direction of arrow B of FIG. 1 into the position in broken lines. In order to return the side rail 16 to its effective position, this sequence of operations may be reversed.

Figure 5B:
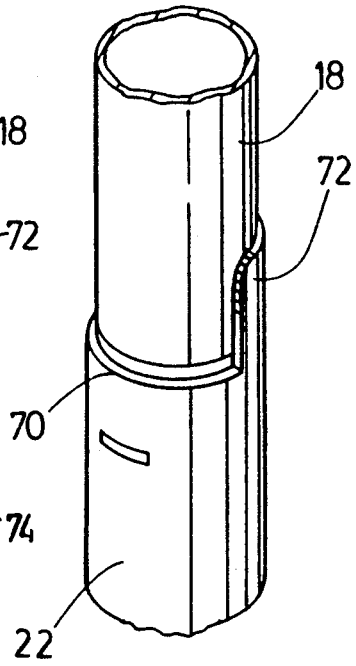
Figure 5C:
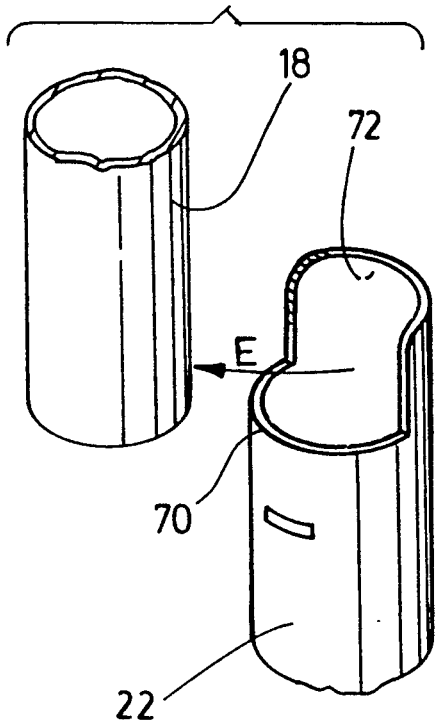

For easy registration of member 18 with leg 22, special provision may be made. When side rail 16 is lifted member 18 arises in the direction of arrow D in FIG. 5*a* to clear a top surface 70. Thus, the position shown in FIG. 5*b* is reached. When member 20 is pivoted in the direction of arrow A, member 18 moves out of registration with leg 22 above surface 70 in the direction of the arrow E shown in FIG. 5*c* and, indeed, in the direction of arrow B in FIG. 1. When the member 20 is pivoted in the opposite direction to that indicated by arrow A, then member 18 returns in the opposite direction to arrow E. A stop surface 72 is provided upstanding from the top of leg 22 to end the travel of member 18 when it is in registration with leg 30 as is shown in FIG. 5*b*. Once this registration has been achieved the side rail 16 may be lowered so that projection 68 descends in arm 64 of slot 62 and member 18 descends in leg 22.

It is possible that upward or downward pressure on side rail 16 may not be exactly symmetrical. Therefore the provision of a stop 74 on the inner surface of leg 30 may help to inhibit excess unsymmetrical descent of member 18 and thus help prevent jamming of member 18 in leg 22. If for aesthetic reasons or other reasons it is desired to remove side rail 16 completely, the retractable button projection 68 maybe retracted and the side rail 16 may be lifted so that both support members 18 and 20 are freed from their respective legs 28 and 22. The side rail 16 including the support members 18 and 20 may then be stored in any suitable location The projecting cross members 24 and 30 will remain an eyesore unless they to are removed. If the cross members 24 and 30 are two-piece cross members connected by a screw fitting, a bayonet fitting or other fitting, they may also be easily removed by disconnecting the fittings and withdrawing them from the respective sockets 26, 32.

Figure 6A:
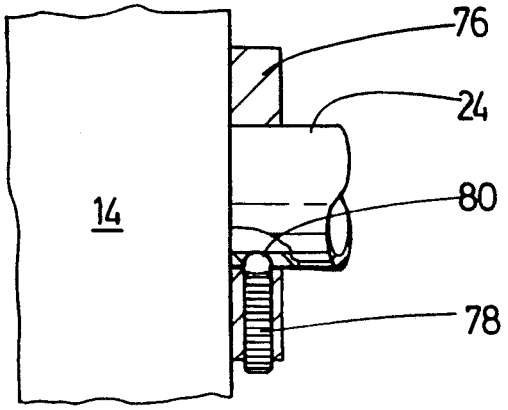
FIG. 6*a, b* and *c* show various alternatives mechanisms for locking a cross member in position.

In use, it is important that these cross members 24, 30 are static with their legs 22, 28 directed accurately upright. This may be achieved by any manner of simple mechanical devices. A variety of such devices is illustrated in FIG. 6 in which FIG. 6*a* shows a disc 76 attachable to the spacer 14 about the respective cross member (24 is shown). A radial bearing screw 78 bears on the cross member in order to lock it in position. Preferably the cross member is provided with a dimple 80 to properly locate the end of screw 78.

Figure 6B:
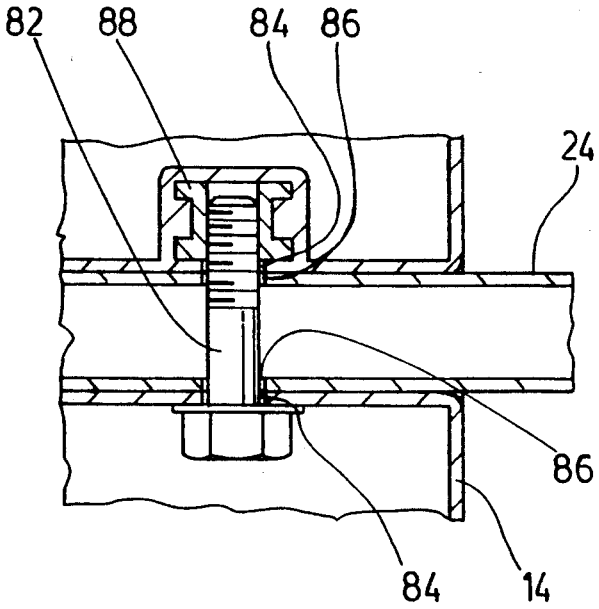

FIG. 6*b* shows a bolt 82 passing through holes 84 in the internal frame of the spacer 14 and through diametric holes 86 of the cross member 24. The bolt is locked in position by nut 88. This particular example of a cross member fixing mechanism depends on a provision of a moulded spacer having internal framework. It may, in fact, be preferable that the spacer is of solid construction for strength reasons.

Figure 6C:
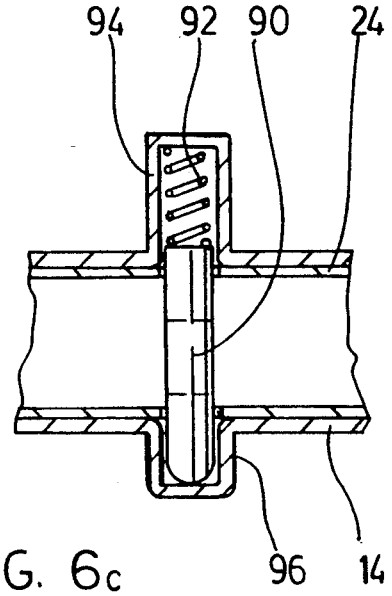

FIG. 6*c* shows yet another example of a means for fixing the cross member 24. In this case the bolt 82 of FIG. 6*b* is replaced by a spring loaded pin 90. A spring 92 bears at one end on the base of a socket 94 and at the other end on the pin 90 to bias it into socket 96. While the example shown is illustrated in an internal frame work of spacer 14, it is possible that an external housing some what similar to disc 76 might be provided for this mechanism.

When both side rails 16 are in effective side rail position, it may be advantageous to provide a safety rail 38. Safety rail 38 must be movable so that it does not impede access to the toilet. Once the person is seated on the toilet. Safety rail 38 may be located in position shown in full lines in FIG. 1 so that it extends from the front end of one side rail 16 to the front end of the other side rail 16. When not in use it may be stored adjacent and parallel to one of the side rails 16 as shown in broken lines 38*a* in FIG. 1. For movement between its in use position and its stored position it may conveniently first hinge upwardly in the direction of the arrow F in FIG. 1 into the position shown in broken lines 38*b*. It may then hinge rearwardly in the direction of arrow G into the position shown as 38*a*. To move it from stored position into use position the sequence of events is reversed. The safety arm 38 may be hinged to the front end of the arm 16 at a hinge point 100 either through a universal joint or through a suitable combination of hinges. Conveniently, suitable securement means may be provided for the free end of arm 38 with the other of side rails 16.

We claim:

1. A conversion kit for raising the height of a flush toilet comprising:

a spacer having a upper surface for attaching to a bottom surface of a flush toilet and conforming thereto in shape and size, and a lower surface for fixing to a floor;

a soil pipe extension through the spacer from a first port in said upper surface to a second port in said lower surface, the first port being located for coincident with a discharge port of the flush toilet and the second port being located for coincidence with a floor port of a soil pipe;

bolt sockets provided through the spacer from top to bottom located to be coincident with bolt sockets of the flush toilet;

fixing bolts to bolt the flush toilet to the floor, each bolt having a shank having a length to pass through the bolt sockets of the spacer;

sealing rings to seal the first port of the soil pipe extension with the discharge port and to seal the second port of the soil pipe extension with the floor port of the soil pipe;

at least one open ended socket extending laterally into and through the spacer, at least one side rail support having a cross member to extend through said open ended socket and extend out of each end thereof, said cross member extends through said spacer from side to side forwardly of the soil pipe extension, a side rail support on each side of the toilet, adapted to be supported by a respective end of said cross member.

2. A conversion kit as claimed in claim 1 in which a stabilizing flange is provided at the base of the spacer having a flange lower surface flush with said lower surface of the spacer.

3. A conversion kit as claimed in claim 1 in which the spacer comprises a plurality of sub-spacers each of which includes bolt sockets for passage of bolts for fixing the toilet to the floor, and in which further sealing rings are provided for sealing between adjacent sub-spacers.

4. A conversion kit as claimed in claim 1 in which a pair of side rails supports are provided, one for connection at each end of the cross member.

5. A conversion kit as claimed in claim 1 in which the spacer has two sockets extending laterally therethrough, a first of which sockets is forward of the soil pipe extension and a second of which sockets is rearward of the soil pipe extension, the sockets to house respective first and second cross members for connection to respective first and second side rail supports of at least one side rail.

6. A conversion kit as claimed in claim 5 in which the spacer comprises a plurality of sub-spacers each of which includes bolt sockets for passage of bolts for fixing the toilet to the floor, and in which further sealing rings are provided for sealing between said sub-spacers.

7. A conversion kit as claimed in claim 6 in which each sub-spacer has mounting sockets extending horizontally therethrough forwardly and rearwardly of the soil pipe extension for variable height mounting said first and second cross members.

8. A conversion kit as claimed in claim 7 in which the sub-spacer horizontal sockets are formed as grooves in the top of each sub-spacer.

9. A conversion kit as claimed in claim 8 in which each of the first and second cross members is a U-shaped ended tube having a web to extend through one of the horizontal sockets and a pair of upturned female legs, each female leg to engage a male member of one of the side rail supports.

10. A conversion kit as claimed in claim 8 in which a pair of the side rail supports is movable between an effective side rail position and a position allowing free access to a side of the flush toilet.

11. A conversion kit as claimed in claim 10 in which the pair of side rail supports is movable by the release of a first of the male members from a respective first female member and hinging of a second of the male members in its respective second female member.

12. A conversion kit as claimed in claim 11 in which said second female member is located rearward of the soil pipe.

13. A conversion kit as claimed in claim 11 in which a movable safety bar is provided to extend, in a first position, between front positions of the side rails and in a second position to provide free access between the side rails.

* * * * *